United States Patent [19]

Lauke

[11] Patent Number: 4,659,450

[45] Date of Patent: Apr. 21, 1987

[54] APPARATUS FOR MAKING AN ELECTRO-IMMERSION FINISH BY FORCED CIRCULATION OF A LIQUID BATH IN A TANK

[75] Inventor: Arno Lauke, Münster, Fed. Rep. of Germany

[73] Assignee: BASF Farben & Fasern AG, Münster, Fed. Rep. of Germany

[21] Appl. No.: 799,914

[22] Filed: Nov. 20, 1985

Related U.S. Application Data

[62] Division of Ser. No. 519,412, Aug. 1, 1983, Pat. No. 4,568,438.

[30] Foreign Application Priority Data

Aug. 2, 1982 [DE] Fed. Rep. of Germany ..... 3228797
Aug. 18, 1982 [DE] Fed. Rep. of Germany ..... 3230660

[51] Int. Cl.[4] ..... C25D 13/12; C25D 13/24
[52] U.S. Cl. ..... 204/299 EC
[58] Field of Search ..... 204/180.8, 180.2, 299 EC, 204/300 EC

[56] References Cited

U.S. PATENT DOCUMENTS 3,404,079 10/1968 Boardman ..... 204/181.6 X
3,496,082 2/1970 Orem et al. ..... 204/300 EC X
3,592,755 7/1971 Thornton ..... 204/299 EC
3,951,775 4/1976 Horton et al. ..... 204/300 EC X
4,196,023 4/1980 Rowe ..... 204/181.3 X
4,361,605 11/1982 Takahashi et al. ..... 204/300 EC X
4,400,416 8/1983 Takahashi et al. ..... 204/300 EC X

OTHER PUBLICATIONS

Reves, H. F., "Electrocoating: New Method in Organic Finishing", *Metal Finishing*, Feb. 1965, pp. 59–67.

*Primary Examiner*—Donald R. Valentine
*Attorney, Agent, or Firm*—Kenyon & Kenyon

[57] ABSTRACT

An improved and substantially contamination free electro-immersion finish is provided on an electrically conductive substrate such as a motor vehicle body. An immersion tank holds an aqueous liquid containing an electrophoretically precipitable resin. The substrate to be coated is immersed in the liquid and transported through the tank. The bath liquid in the lower region of the tank is circulated parallel to the direction of transport of the substrate. The bath liquid in the upper region is circulated opposite to the direction of transport of the substrate. The bath liquid may be recirculated by removing the liquid from the tank at the end of the tank where the substrate is removed from the tank. The bath liquid may be purified by filter units prior to being returned to the tank. A separator, such as a cyclone separator, may be disposed in the liquid recirculation conduit ahead of the filtration units.

7 Claims, 2 Drawing Figures

APPARATUS FOR MAKING AN ELECTRO-IMMERSION FINISH BY FORCED CIRCULATION OF A LIQUID BATH IN A TANK

This is a division of application Ser. No. 519,412 filed Aug. 1 1983, now U.S. Pat. No. 4,568,438 issued Feb 4, 1986.

FIELD OF THE INVENTION

This invention relates to a method and apparatus for providing an electro-immersion finish on a substrate. An electrically conductive substrate is immersed in an aqueous bath containing an electrophoretically precipitable resin. The bath liquid is forcibly and continuously circulating in the tank holding the bath. A voltage is applied between the substrate and at least one counter-electrode positioned within the tank. The substrate is covered with a coating and then is removed from the bath. After the substrate is removed from the bath, the coating may be baked on.

BACKGROUND OF THE INVENTION

Automobile bodies, home appliances such as refrigerators, dish washers, washing machines and the like may be primed, for example, by means of a so-called electro-immersion finish. This priming is customarily followed by an overall varnish build-up which may comprise several layers which essentially include a base filler and a cover varnish. The substrate to be primed is introduced into an electro-immersion varnish bath and coated in a few minutes. After removal from the bath, the substrate is rinsed, the applied varnish is baked on, and the primed surfaces are processed mechanically. Subsequently, the base filler is applied.

It is unavoidable that the immersion bath becomes contaminated with and contains fine particles. Accordingly, there is a need to filter the bath liquid. Is is also unavoidable that very fine particles settle on the primed surfaces and therefore a roughness is formed on the surfaces. Thus, these surfaces must be specially reworked. This rework is generally performed by mechanical processes such as sanding. The process cycle of the mechanical finishing is time-consuming and expensive.

To prevent settling of bath material, the treatment bath, i.e., the liquid of thc treatment bath, is continuously circulated within the bath and is recirculated by removing the liquid from the bath and conducting it through a so-called ultra-filtration loop and a simple filter loop. The state of the art regarding keeping the bath liquid clean is therefore unsatisfactory. It is a frequent occurrence, especially after interruptions of the operation, that the filters are clean and clear, but the substrates which are coated are dirty. In this connection, it must be mentioned that part of the dirt is removed from the bath by the substrates themselves. Therefore, the substrates are cleaner when there is a greater throughput.

OBJECT OF THE INVENTION

It is therefore an object of the present invention to provide an improved method and apparatus for making an electro-immersion finish on the surface of a substrate wherein the quantity of dirt adhering to the coated substrate as a result of the electro-immersion finishing process is substantially reduced.

It is a further object of the present invention to substantially reduce the quantity of dirt adhering to a coated surface of a substrate resulting from an electro-immersion finishing process in a very simple and cost-effective manner.

It is yet another object of the present invention to provide a method for making an electro-immersion finish on the surface of a substrate wherein mechanical reworking of the coated surface due to adhered dirt is substantially avoided.

These and other objects of the present invention will become apparent from the following description and claims in conjunction with the drawings.

SUMMARY OF THE INVENTION

The present invention may be generally summarized as a method for making an electro-immersion finish including the steps of:

providing an immersion tank holding an aqueous liquid bath containing an electrophoretically precipitable resin;

immersing an electrically conductive substrate into said aqueous liquid bath;

transporting said substrate through said forcibly and continuously circulating said bath liquid in said immersion tank;

applying a voltage between said substrate and at least one counter-electrode disposed in said bath;

coating said substrate with said resin;

removing said substrate from said bath; and baking-on said coating with the improvement comprising:

circulating said bath liquid in the lower region of said immersion tank concurrent to the direction of transport of said substrate; and circulating said bath liquid in the upper region of said immersion tank counter to the direction of transport of said substrate.

Preferably, the bath liquid is recirculated by removing the liquid from the tank in the vicinity of the tank end where the substrate is removed from the tank. The removed liquid is purified by filters, and optionally separator means, and then returned to the tank.

The present invention may also be generally summarized as an apparatus for providing an electro-immersion finish on a substrate comprising a tank for holding an aqueous liquid containing an electrophoretically precipitable resin with the tank having a first end and a second end, means for transporting the substrate from the first end to the second end of the tank, nozzle means within the tank for causing forced motion of the liquid within the tank, and means associated with the tank for removing liquid therefrom, with the improvement comprising:

the nozzle means have discharge openings positioned near the bottom of the tank and the discharge openings are directed in the direction of transport of the substrate toward the second end of the tank.

Preferably, a weir or drain is located in the vicinity of the second end of the tank for removing liquid from the tank. Conduit means connect the weir or drain to the nozzles for recirculating the liquid. Filter means and optionally separator means,are disposed in the liquid recirculating conduit means for cleaning the liquid.

The electro-immersion finishing method and apparatus of the present invention are particularly useful for coating the bodies of motor vehicles and home appliances such as refrigerators, dish washers, washing machines and the like.

In accordance with the present invention, the dirt profile in the bath of the prior art immersion tanks was checked. It was determined that in the customary prior art practices, the greatest accumulation of dirt occurs at the end of the tank in the vicinity of the substrate entry where, in accordance with prior art practice,the direction of movement of the circulating bath liquid in the vicinity of the bottom nozzles is in the direction toward the entry end of the tank. In addition, in the prior art practice, the direction of movement of the circulating bath liquid in the upper regions of the tank takes place in the same direction as the transport direction of the substrate.

In accordance with the method and apparatus of the present invention, the substrate is immersed in the tank in a region at which the dirt concentration is a minimum. Surprisingly, it has been found that with such a procedure, in accordance with the present invention, the amount of dirt adhering to the substrate as a result of the electro-immersion coating process is strikingly reduced in comparison with the prior art practices.

BRIEF DESCRIPTION OF THE DRAWINGS

In the drawings forming part hereof.

In the figures of the drawings, like reference numerals indicate like parts.

DETAILED DESCRIPTION

In order to afford a more complete understanding of the present invention and an appreciation of its advantages, a description of the preferred embodiments is presented below.

Figure 1:
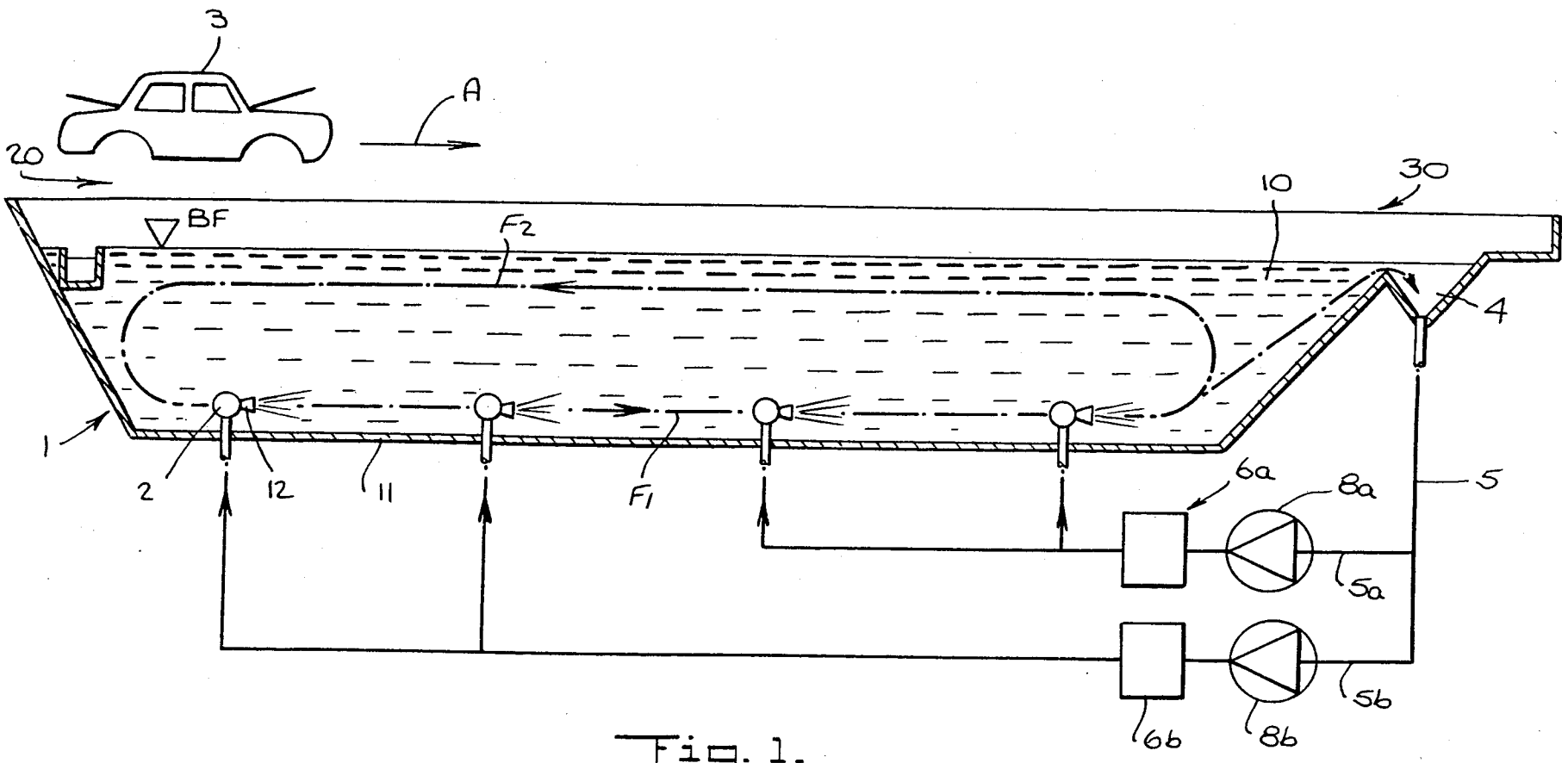
FIG. 1 is a schematic side elevation view illustrating one embodiment of the electro-immersion process and apparatus in accordance with one embodiment of the present invention.
Figure 2:
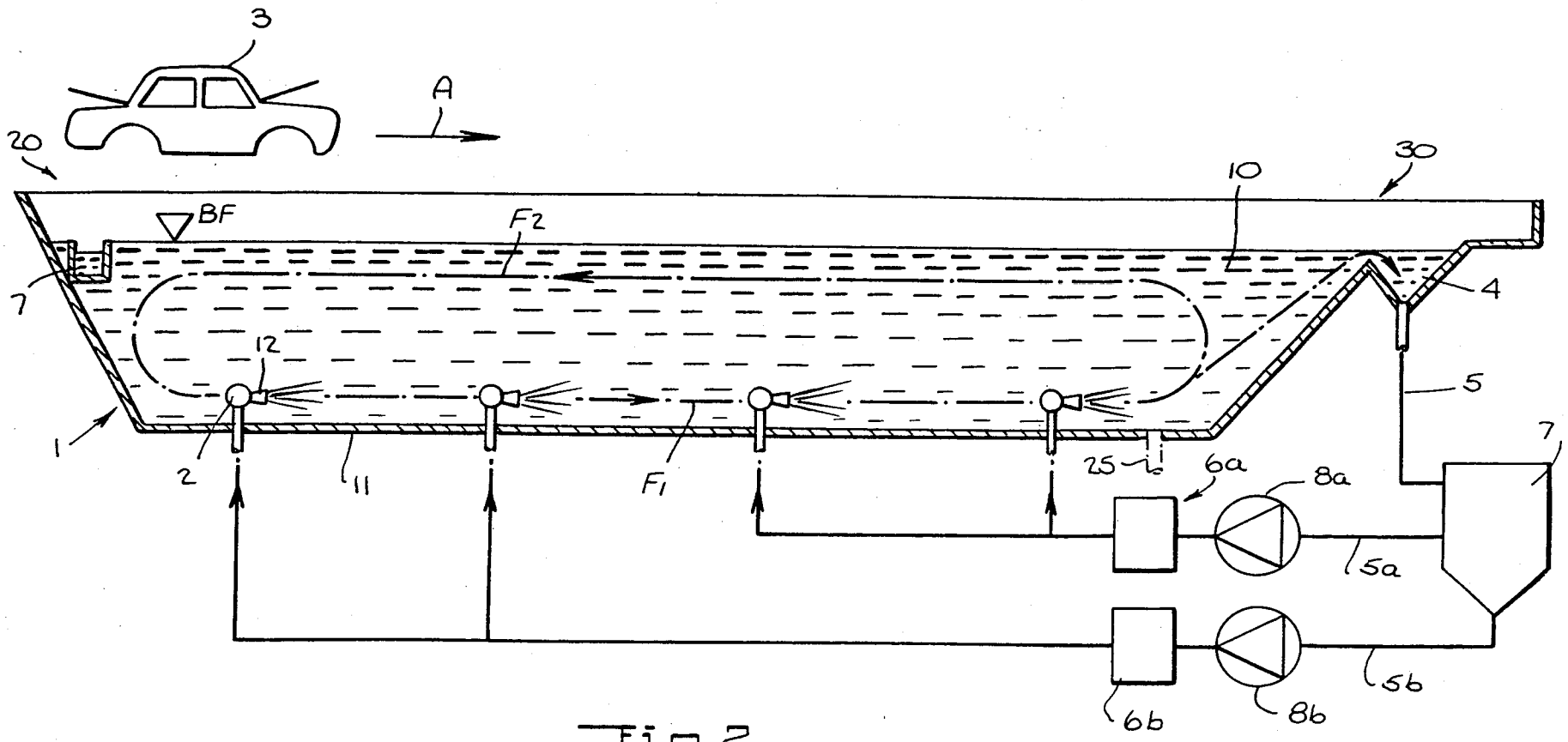
FIG. 2 is a schematic side elevation view illustrating another embodiment of the electro-immersion process and apparatus in accordance with another embodiment of the present invention.

In FIGS. 1 and 2, there is illustrated a treatment or immersion tank 1 for holding an aqueous liquid bath 10 containing an electrophoretically precipitable resin. A plurality of feed nozzles 2 are arranged at the bottom of the tank 1 and are disposed along the length of the tank from the vicinity of a first end 20 to the vicinity of a second end 30. The discharge openings or orifices 12 of the nozzles 2 are located in the bottom region of the tank near the tank bottom 11. The triangle BF indicates the surface of the bath liquid 10.

An automobile body 3 [by way of example of a substrate to be coated]is to be immersed into the liquid bath 10 in the vicinity of the first end 20 of the tank. The automobile body 3 will be transported through the bath liquid 10 in the direction indicated by the arrow A toward the second end of the tank 30. The automobile body will be removed from the coating liquid bath 10 near the vicinity of the second end of the tank 30.

Means for immersing the automobile body into the liquid bath, means for transporting the automobile body through the liquid bath, and means for removing the automobile body from the liquid bath are not illustrated because they are well known in the art of electro-immersion finishing and in themselves are not the invention. One skilled in the art will also appreciate that at least one electrode will be provided in the bath 10. Means will be provided to electrically connect the automobile body and the electrode to an electrical voltage source. The automobile body and the electrode will be of opposite polarities with the polarities selected in accordance with the electrical charge on the resin particles to be coated on the automobile body. These parts are not illustrated and the electrophoretic coating process is not described in detail because they are well known in the art of electro-immersion finishing.

At end 30 of the tank 1, a waste weir 4 is provided. The bath liquid 10 is drawn off or removed from the tank 1 by weir 4. Fluid conduit means 5 is connected in fluid communication with weir 4 and the plurality of nozzle means 2 for providing a fluid conduit loop for recirculating and purifying or cleaning the bath liquid. Fluid conduit means 5 branches into fluid conduit means **5*a* and 5*b* in the embodiment illustrated. Fluid conduit means 5*a* and 5*b* are in turn connected in fluid communication with a plurality of nozzles 2**.

Suitable filters will be provided in the bath liquid recirculation loop for cleaning or purifying the bath liquid. In the illustrated emobidment, ultrafiltration filter **6*a* is disposed in fluid conduit means 5*a*. Dirt filter 6*b* is disposed in fluid conduit means 5*b*. Pump means 8*a* is disposed fluid conduit means 5*a* upstream of ultrafiltration filter 6*a*. Pump means 8*b* is disposed in fluid conduit means 5*b* upstream of dirt filter 6*b*. The pump means are provided for recirculating the bath liquid removed from the tank 1 at weir 4 and for forcibly injecting the bath liquid back into the tank through a plurality of nozzles 2** arranged at the bottom of the tank.

The forcible discharge of bath liquid from nozzles 2 in the bottom region of the bath causes a circulation motion of the bath liquid in the tank in the directions indicated by the arrows $F_1$ and $F_2$. This is a forced circulation which takes place due to the spraying pressure of the nozzles. The discharge openings or orifices 12 of the nozzles 2 are directed toward end 30 of the tank 1. That is, bath liquid is discharged from openings or orifices 12 of nozzles 2 in a direction parallel to the direction of transport of the substrate 3 through the tank (indicated by arrow A).

It can be seen that the direction of movement of the bath liquid in the bottom region of the bath 10 near the bottom 11 of the tank is parallel to or concurrent to the direction of transport or motion of the substrate 3 through the bath 10. On the other hand, the direction of movement of the bath liquid in the top region of the bath 10 near the surface of the bath (indicated by triangle BF) is against or counter-current to the direction of transport or motion of the substrate 3 through the bath 10.

At the end of the tank 20 opposite to the end where waste weir 4 is located, an overflow channel 7 is provided. The overflow channel 7 serves to remove foam from the bath 10. This foam is partially loaded with fine dirt particles and it cannot be drawn off from the tank via the waste weir 4.

In accordance with the arrangement of the method and apparatus of the present invention dirt accumulates in the bath 10 at end 30 of the tank ahead of the waste weir 4 so that automobile bodies or other substrates to be immersed in the bath 10 are immersed in a relatively clean bath liquid and are then moved from the clean bath liquid toward the relatively contaminated bath liquid. As hereinbefore discussed, in accordance with the present invention, such a procedure surprisingly and strikingly reduces the amount of adhered dirt on the substrate in comparison with the prior art practices.

In accordance with another feature of the present invention and with reference to FIG. 2, a separator 7 may be advantageously disposed in the recirculating fluid conduit means 5. In the embodiment of FIG. 2, the separator 5 is disposed in recirculating fluid conduit means 5 upstream from the filter units 6*a*, 6*b*, and the pumping means 8*a*, 8*b*. The separator 5 may be a cyclone or centrifugal separator.

In accordance with another embodiment of the present invention, recirculation of the bath liquid may be provided for by disposing a drain (illustrated in phantom in FIG. 2 as part 25) in or near the tank bottom in the vicinity of tank end 30 where the substrate is removed from the tank. That is, the drain is disposed in the tank in the region where the dirt accumulation is greatest. The drain 25 would be connected to fluid conduit means 5 to provide for recirculation and purifying of the bath liquid.

Although preferred embodiments of the present invention have been described in detail, it is contemplated that modifications may be made within the spirit and the scope of the present invention.

What is claimed is:

1. An apparatus for providing an electro-immersion finish comprising:

an immersion tank for holding a liquid bath, said immersion tank having a first end, a second end opposite to and spaced a length from said first end, and a bottom;

a liquid bath disposed in said immersion tank, said liquid bath having a top surface;

means for immersing an electrically conductive substrate in said liquid bath near the first end of said immersion tank and for transporting said electrically conductive substrate immersed in said liquid bath along said length in a direction from said first end to said second end of said immersion tank;

electrode means disposed in said liquid bath for applying a voltage between said electrically conductive substrate and said electrode means;

means for removing bath liquid from said liquid bath located at said second end of said tank;

a plurality of nozzle means means each having a discharge opening located near the bottom of said immersion tank with said discharge openings oriented to discharge liquid in the direction of transport from said first end to said second end of said immersion tank;

said nozzle means being disposed spaced apart along said length parallel to said direction of transport from near said first end to near said second end of said immersion tank;

conduit means for placing said means for removing bath liquid and said nozzle means in fluid communication and for forcibly and continuously ejecting bath liquid through said discharge openings of said nozzle means;

whereby said bath liquid is forcibly and continuously circulated near the bottom of said immersion tank concurrent to the direction of transport of said electrically conductive substrate and along said length of said immersion tank; and whereby said bath liquid is forcibly and continuously circulated near said top surface of said liquid bath counter to the direction of transport of said electrically conductive substrate and along the length of said immersion tank.

2. An apparatus as recited in claim 1 wherein said means for removing bath liquid from said immersion tank comprises a weir located at said second end of said immersion tank.

3. An apparatus as recited in claim 1 wherein said means for removing bath liquid from said immersion tank comprises a drain means located at the bottom of said immersion tank near said second end.

4. An apparatus as recited in claim 1 wherein said conduit means further includes separator means disposed in said conduit means for cleaning said bath liquid removed from said immersion tank.

5. An apparatus as recited in claim 4 wherein said separator means is a centrifugal separator.

6. An apparatus as recited in claim 1 which further includes means located at the first end of said immersion tank for removing foam from the top surface of said liquid bath.

7. An apparatus as recited in claim 1 wherein said electrically conductive substrate is a motor vehicle body.

* * * * *